United States Patent [19]

Ferrara

[11] Patent Number: 4,546,948

[45] Date of Patent: Oct. 15, 1985

[54] EASEL

[75] Inventor: Daniel A. Ferrara, Bantam, Conn.

[73] Assignee: Summagraphics Corporation, Fairfield, Conn.

[21] Appl. No.: 477,301

[22] Filed: Mar. 21, 1983

[51] Int. Cl.[4] ..... A47G 1/24

[52] U.S. Cl. ..... 248/454

[58] Field of Search ..... 248/188.2, 188.1, 166, 248/168, 454–457; 108/1, 9, 10

[56] References Cited

U.S. PATENT DOCUMENTS

| | | | |
|---|---|---|---|
| 264,995 | 9/1882 | Armstrong | 248/456 |
| 655,284 | 8/1900 | Thiers | 108/9 |
| 685,458 | 10/1901 | McIntyre | 248/455 |
| 1,002,147 | 8/1911 | Harris | 248/455 |
| 1,079,033 | 11/1913 | Steinhoff | 248/454 |
| 2,687,932 | 8/1954 | Hokanson | 108/1 |
| 2,755,152 | 7/1956 | Calgy | 108/1 |
| 3,393,846 | 7/1968 | Cannon | 248/188.2 |
| 3,920,213 | 11/1975 | Hanson | 248/455 |
| 4,032,099 | 6/1977 | Maude | 248/188.2 |

*Primary Examiner*—Reinaldo P. Machado
*Assistant Examiner*—Alvin Chin-Shue
*Attorney, Agent, or Firm*—Daniel M. Rosen

[57] ABSTRACT

A guide is affixed to the lower surface of a tablet. A rail is reciprocally movable in the guide in a plane parallel to the lower surface of the tablet. A strut is affixed to the rail and extends perpendicular to the plane of the lower surface of the tablet to support the tablet at an angle to the surface. The longitudinal axis of the strut is substantially perpendicular to the longitudinal axis of the rail and substantially parallel to the plane of the lower surface of the tablet.

1 Claim, 6 Drawing Figures

T 5

FIG. 3
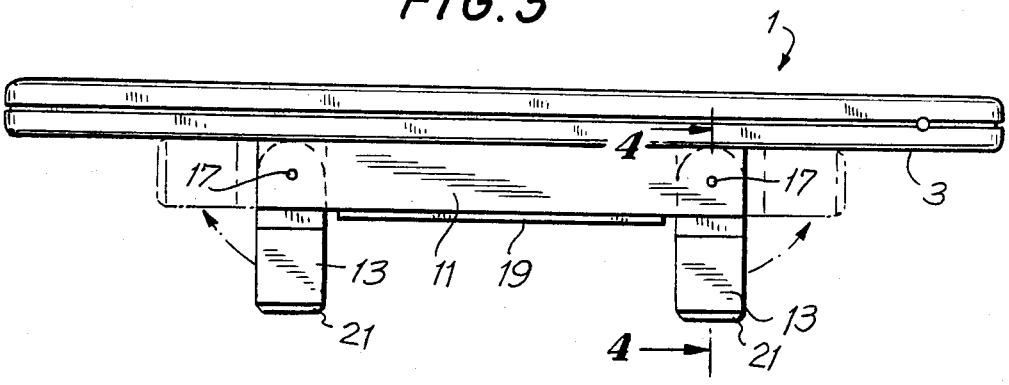
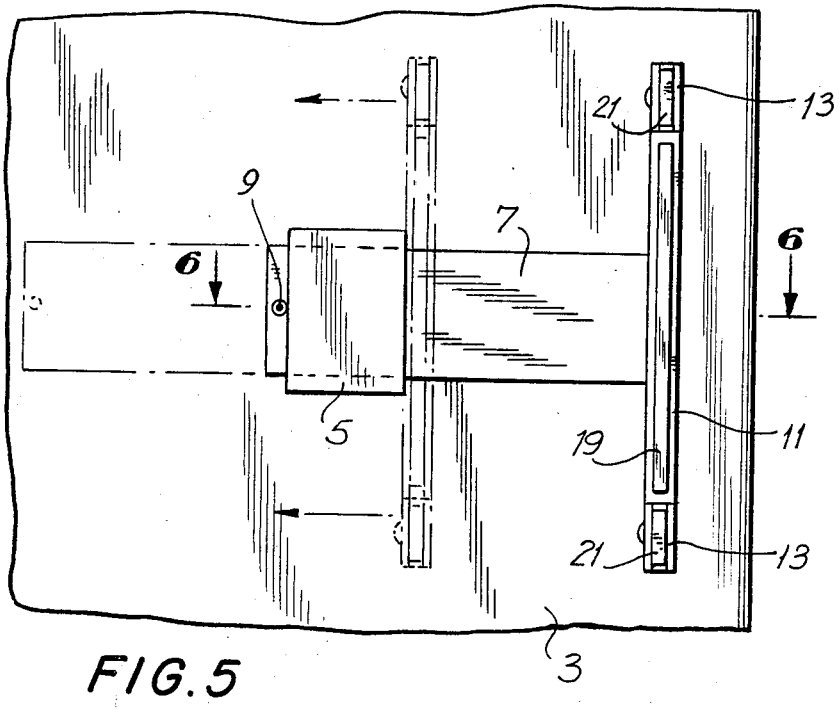
FIG. 5
FIG. 4
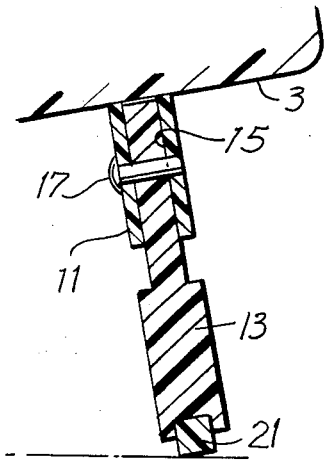
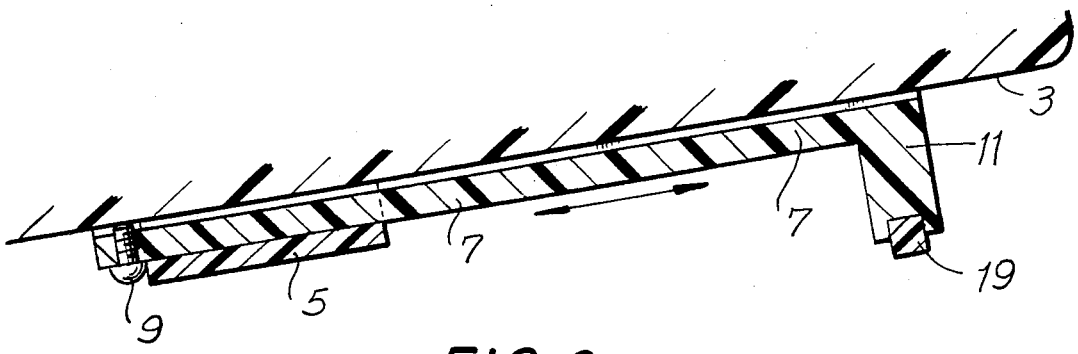
FIG. 6

EASEL

BACKGROUND OF THE INVENTION

1. Field of the Invention

The present invention relates to a support for a small tablet or the like, and in particular, an adjustable support for a digitizer tablet.

2. Prior Art

Digitizers generally comprise a tablet having a conductor grid line therein or directly under the surface. Signals are coupled between the grid and a cursor moved over the tablet surface. Through proper circuitry this signal can represent the cartesian coordinates of the cursor on the tablet. Thus, an operator may place a drawing or the like on the tablet and generate stored data in a computer representing points or lines on the drawing simply by tracing out the points or lines with the cursor.

Tablets come in various sizes. Large tablets, for example, 48"×48", require their own table or legs to independently support the tablet. Smaller tablets, for example, 12"×12", or 18"×18", are often constructed to fit upon desk tops.

Many small prior art tablets consisted solely of the flat tablet surface. Thus, when placed upon the desk, they lay parallel to the desk top. This arrangement required that an operator, when moving the cursor over the tablet surface, lean over the tablet to have a good view of the surface. In this position the operator is often uncomfortable and the strain caused errors in his digitizing the drawing or other objects on the tablet surface.

In order to overcome the disadvantages of having the tablet lie flat on the surface, some prior art devices had small legs under one end of the tablet. When placed upon the desk top, the tablet would then sit at an angle to the top surface of the desk. This arrangement permitted the operator to assume a more normal position in his chair when digitizing a drawing or the like. Unfortunately, a compromise had to the made in the length of the legs so that one leg length could accommodate many different operators.

Accordingly, it is the object of the present invention to provide a support for a digitizer tablet.

It is another object of the present invention to provide such a support that will maintain the digitizer tablet at an angle to a substantially horizontal support surface.

It is another object of the present invention to provide such an easel support that it is easily adjustable to provide a plurality of angles at which the digitizer tablet may be maintained relative to the horizontal support surface.

It is another object of the present device to provide for such an easel support in a simple, clean, and attractive and relatively inexpensive construction.

SUMMARY OF THE INVENTION

A guide is affixed to the lower surface of a tablet. A leg is reciprocally movable in the guide in a place parallel to the lower surface of the tablet. A strut is affixed to the leg and extends perpendicular to the plane of the lower surface of the tablet to support the tablet at an angle to the surface.

DESCRIPTION OF THE DRAWINGS

A more complete appreciation of the present invention and many of its attendant features will be readily apparent by reference to the following description when considered in connection with the accompanying drawings.

FIG. 3 is a rear plan videw of a digitizer tablet with the easel of the present invention.

FIG. 4 is a cross-sectional view along line 4—4 of FIG. 3.

FIG. 5 is a partial bottom plan view of the digitizer tablet with the easel of the present invention.

FIG. 6 is a cross-sectional view along 6—6 of FIG. 5.

Figure 1:
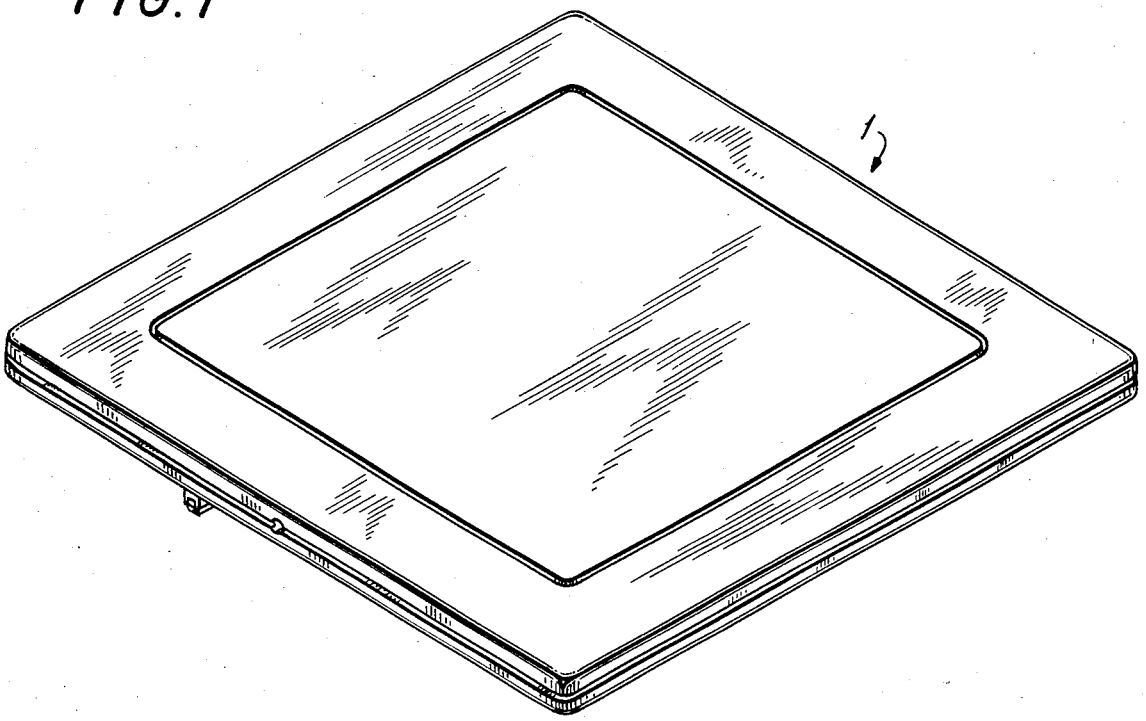
FIG. 1 is a perspective view of the digitizer tablet for which the present invention is particularly well suited.
Figure 2:
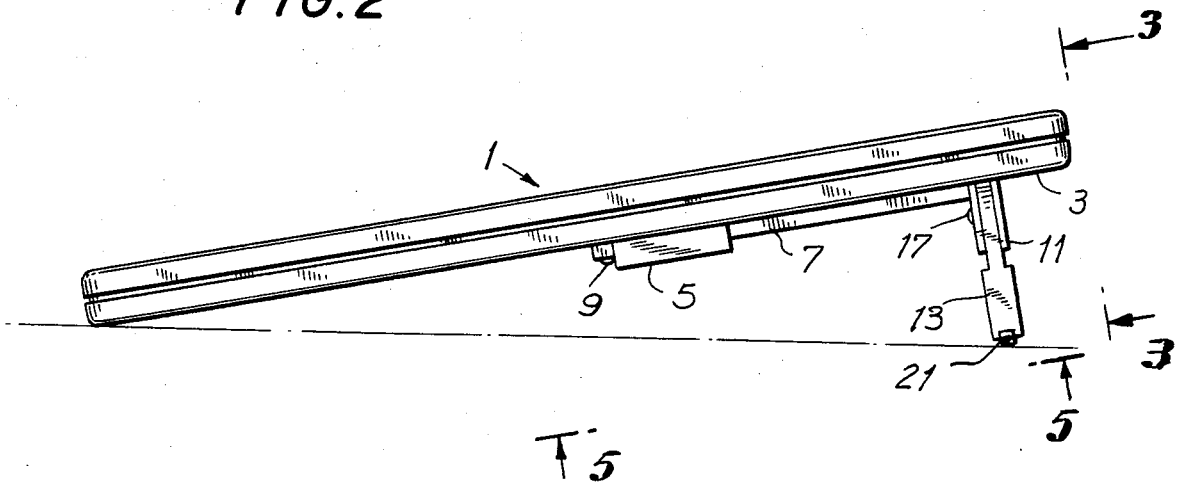
FIG. 2 is a side plan view of a digitizer tablet with the easel of the present invention.

The present invention will be best understood from consideration of the following detailed description taken in connection with the above-described drawings. However, one skilled in the art will recognize that the invention is not confined to the embodiment shown and described.

DESCRIPTION OF THE INVENTION

Referring now to the drawings, an embodiment of the present invention can be seen. For ease of understanding, like reference numbers designate corresponding parts in the various embodiments disclosed.

Referring to FIG. 1, digitizer tablet 1 is illustrated. Digitizer tablet 1 has a lower surface 3. Affixed to lower surface 3 is a guide 5. In the preferred embodiment, guide 5 is molded to digitizer tablet 1.

Movable in guide 5 is a rail 7. As best can be seen in FIGS. 5 and 6, rail 7 can reciprocate in guide 5 in a plane parallel to that of lower surface 3.

At one end of rail 7 is a stop 9. In the preferred embodiment stop 9 is an ordinary screw imbedded into the end of rail 7.

Affixed to the other end of rail 7 is a strut 11. Strut 11 in the preferred embodiment is substantially perpendicular to the lower surface 3 of tablet 1.

At each end of the longitudinal axis of strut 11 are legs 13. Legs 13 fit into grooves 15 cut in strut 11. Pins 17 extend through the ends of strut 11 through legs 13 permitting legs 13 to rotate about pins 17. As best can be seen in FIG. 3 legs 13 rotate from a first position whereat legs 13 extend no further from lower surface 3 of said tablet 1 than does strut 11 to a second position whereat legs 13 extend further from lower surface 3 than does strut 11.

The preferred embodiment also has cushions 19 on the edge of strut 11 and cushions 21 on the ends of legs 13. One skilled in the art will recognize that cushions 19 and 21 provide protection from marking and scratching of the surface upon which tablet 1 may rest.

OPERATION OF THE INVENTION

During the period when tablet 1 is being transported or stored, legs 13 are rotated into the first position whereat they do not extend further from the lower surface 3 of tablet 1 than does strut 11. When it is desired to utilize tablet 1, legs 13 may be left in that first position or rotated into a second position whereat they extend further from the lower surface 3 of tablet 1 than does strut 11. In either of these positions, rail 7 may be reciprocated in guide 5 to move strut 11 closer or further from guide 5.

The closer strut 11 is to guide 5 the greater will be the angle between the plane of tablet 1 and that of the surface upon which tablet 1 rests. Thus, by variously rotating legs 13 and positioning strut 11 along the lower surface 3, the angle at which tablet 1 can be supported to a horizontal surface can be widely varied.

While the invention has been described by a specific embodiment, it is not limited thereto. Obviously modification will occur to those skilled in the art. For example, various other positions can be devised to which legs 13 can be rotated. Further, guide 5 could be placed at other positions on lower surface 3 to provide even greater angles at which tablet 1 could be supported on a horizontal surface. Thus, one skilled in the art could create various modifications without departing from the scope of this invention as defined by the following claims.

What is claimed is:

1. An adjustable easel to support a tablet having a planar lower surface at an angle to a surface comprising:

a guide rigidly affixed to the lower surface of said tablet;

a rail reciprocally movable in said guide in a plane parallel to the lower surface of said tablet;

a strut affixed to said rail and substantially perpendicular to the plane of the lower surface of said tablet to support said tablet at an angle to the surface, wherein the longitudinal axis of said strut is substantially perpendicular to the longitudinal axis of said rail and substantially parallel to the plane of the lower surface of said tablet; and first and second rotatable legs arranged at each end of said strut, each of said legs being affixed to rotate from a first position, whereat no part of said leg is further from said lower surface of said tablet than the part of said strut furthest from said lower surface, to a second position whereat some portion of said leg extends further from said lower surface than any portion of said strut.

* * * * *

UNITED STATES PATENT AND TRADEMARK OFFICE

CERTIFICATE OF CORRECTION

PATENT NO. : 4,546,948

DATED : October 15,1985

INVENTOR(S) : DANIEL A. FERRARA

It is certified that error appears in the above-identified patent and that said Letters Patent is hereby corrected as shown below:

Column 1, line 55, omit "and".

Column 2, line 8, change "videw" to -- view --.

Signed and Sealed this

*Twenty-ninth* Day of *July 1986*

[SEAL]

*Attest:*

DONALD J. QUIGG

*Attesting Officer*

*Commissioner of Patents and Trademarks*